US009752082B2

(12) United States Patent
Saidakovsky et al.

(10) Patent No.: US 9,752,082 B2
(45) Date of Patent: Sep. 5, 2017

(54) TREATMENT PROCESS AND APPARATUS FOR REDUCING HIGH VISCOSITY IN PETROLEUM PRODUCTS, DERIVATIVES, AND HYDROCARBON EMULSIONS, AND THE LIKE

(71) Applicants: Lazarus Saidakovsky, Thornhill (CA); Sergey Rakhinskiy, Maple (CA); Nicolai Novikov, Rybinsky (RU)

(72) Inventors: Lazarus Saidakovsky, Thornhill (CA); Sergey Rakhinskiy, Maple (CA); Nicolai Novikov, Rybinsky (RU)

(73) Assignee: 1861244 ONTARIO INC, Richmond Hill, Ontario (CA)

( * ) Notice: Subject to any disclaimer, the term of this patent is extended or adjusted under 35 U.S.C. 154(b) by 51 days.

(21) Appl. No.: 14/756,944

(22) Filed: Nov. 2, 2015

(65) Prior Publication Data

US 2016/0060543 A1 Mar. 3, 2016

Related U.S. Application Data

(62) Division of application No. 13/987,031, filed on Jun. 27, 2013, now Pat. No. 9,528,050.

(51) Int. Cl.

| | |
|---|---|
| ***C10G 15/00*** | (2006.01) |
| ***C10G 33/02*** | (2006.01) |
| ***C10G 33/06*** | (2006.01) |
| ***C10G 33/00*** | (2006.01) |

(52) U.S. Cl.

CPC ..... *C10G 15/00* (2013.01); *C10G 33/00* (2013.01); *C10G 33/02* (2013.01); *C10G 33/06* (2013.01); *C10G 2300/302* (2013.01)

(58) Field of Classification Search

CPC ..... C10G 15/00; C10G 33/00; C10G 33/02; C10G 33/06; C10G 2300/302

See application file for complete search history.

(56) References Cited

U.S. PATENT DOCUMENTS

| | | | | |
|---|---|---|---|---|
| 3,200,567 A * | 8/1965 | May | B01D 17/04 | 210/259 |
| 3,594,314 A * | 7/1971 | Bilhartz | B01D 17/04 | 208/187 |
| 5,717,181 A * | 2/1998 | Colgate | C10G 15/00 | 204/157.15 |
| 2009/0038932 A1* | 2/2009 | Denslow | B01F 5/10 | 204/157.15 |
| 2010/0101978 A1* | 4/2010 | Gordon | C10G 9/007 | 208/49 |

* cited by examiner

*Primary Examiner* — Randy Boyer
*Assistant Examiner* — Juan Valencia
(74) *Attorney, Agent, or Firm* — David W. Wang

(57) ABSTRACT

The reduction of viscosity of petroleum products and hydrocarbon emulsions and the like is effected by applying electrodynamic shocks unto a foaming streamflow of the high viscosity emulsion to create a densely whirled streamflow by agitation with a high radial gradient of pressure. Chemical bonding breakup and destruction of long structured molecules of paraffin occur in the emulsion to result in the formations of free radicals and carbamides, and separation of a processed mixture into light and heavy fractions. The process alters the physiochemical properties of the emulsion to cause decrease of density, and the reduction of viscosity.

5 Claims, 3 Drawing Sheets

TREATMENT PROCESS AND APPARATUS FOR REDUCING HIGH VISCOSITY IN PETROLEUM PRODUCTS, DERIVATIVES, AND HYDROCARBON EMULSIONS, AND THE LIKE

This application is a divisional of U.S. Pat. No. 9,528,050 issued on Dec. 27, 2016 to the same applicants of this application.

BACKGROUND OF THE INVENTION

1. Field of the Invention

This invention relates to the process and apparatus for treating petroleum products such as oil or bitumen, and stable high viscosity oil emulsions for viscosity reduction, refinement and separation of emulsions. The process and apparatus are applicable in oil mining and petroleum processing industries, for refining and utilization of oil slurries to enhance the flow of the product through conduction means such as pipelines.

2. Background Art

It has been problematic in the transmission and transfer of petroleum products, derivatives, and hydrocarbon emulsions and the like having high viscosity. The highly viscous mass of such products requires significant energy consuming and complex treatments for cleaning, viscosity reduction, and separating oil emulsion before it can be delivered for further processes.

SUMMARY OF THE INVENTION

The essence of the present invention is in applying electrodynamic shocks unto a forming streamflow of high viscosity emulsion to create a densely whirled streamflow by agitation with a high radial gradient of pressure. It generates a steady aelotropic (anisotropic) turbulence while acoustic oscillations of sonic/ultrasonic frequencies are also introduced into the thus agitated flow. Such exposures causes a warming up of the streamflow, due to cavitation and formations of strong impulses of pressure and an intensification of heat exchange processes. Under all these factors, chemical bonding breakup and a destruction of long structured molecules of paraffin would take place resulting in the formations of free radicals and carbamides, and separation of a processed mixture into light and heavy fractions. Thus, the above processes would result in the alterations of the physicochemical properties of the oil causing decreases in density, and the reduction of viscosity etc. The processing sequence technically results in rising efficiencies and lowering the energy consumption needs for treating oil, petroleum products and highly viscous oil emulsions.

The distinctive peculiarity of the methodology of this invention is such that the moving mass flow, forming swirling, tensely twisted stream of the petroleum product is impacted by electro-hydrodynamic shocks, and while a swirling flow has already been thusly formed, it is additionally exposed to acoustic oscillation in the sonic/ultrasonic frequency range. Also, a static pressure is created in the central streamflow of the product to invoke and to generate therein intensive, highly developed cavitations followed by an output of thus treated product from the central streamflow for further usage. Effects of electro-hydrodynamic impacts are realized by way of pulsating electrical charges released within the streamflow in the direction perpendicular to the flow motion vector. Acoustic oscillations are introduced prior to the output of the peripheral and central flow; and while a propagating direction of longitudinal vibrations is towards each other, it is opposite to the direction of axial velocities of the central and peripheral flows respectively; also the planes of generated oscillations are positioned perpendicular to the central axis of the swirling flow.

Another important aspect of this methodology is that the input module contains a discharging chamber wired to the switching electrical generator, and a vortex chamber is equipped with transducers strategically located on the end walls of the chamber. The plane of the working surface of the transducers is perpendicular to the central axis of the vortex chamber, and while the transducers are receiving their feed from sonic/ultrasonic frequencies generators, hydro-cavitational equipment features two output devices with turbulizers are deployed near the end walls in the opposite ends of the vortex chamber. The input module located at a nearest end of the vortex chamber is connected via pipelines by way of controlled shutters to the respective storage tanks for input and treated products; while the output module, located at farthest from the input module end of the vortex chamber, is pipeline-connected via the controlled shutter to the storage tank of the input products.

BRIEF DESCRIPTION OF THE DRAWINGS

Other objects and advantages of the present invention will become apparent from the following detailed description of the preferred embodiments thereof in connection with the accompanying drawings, in which.

DETAILED DESCRIPTION OF THE PREFERRED EMBODIMENTS

Figure 1:
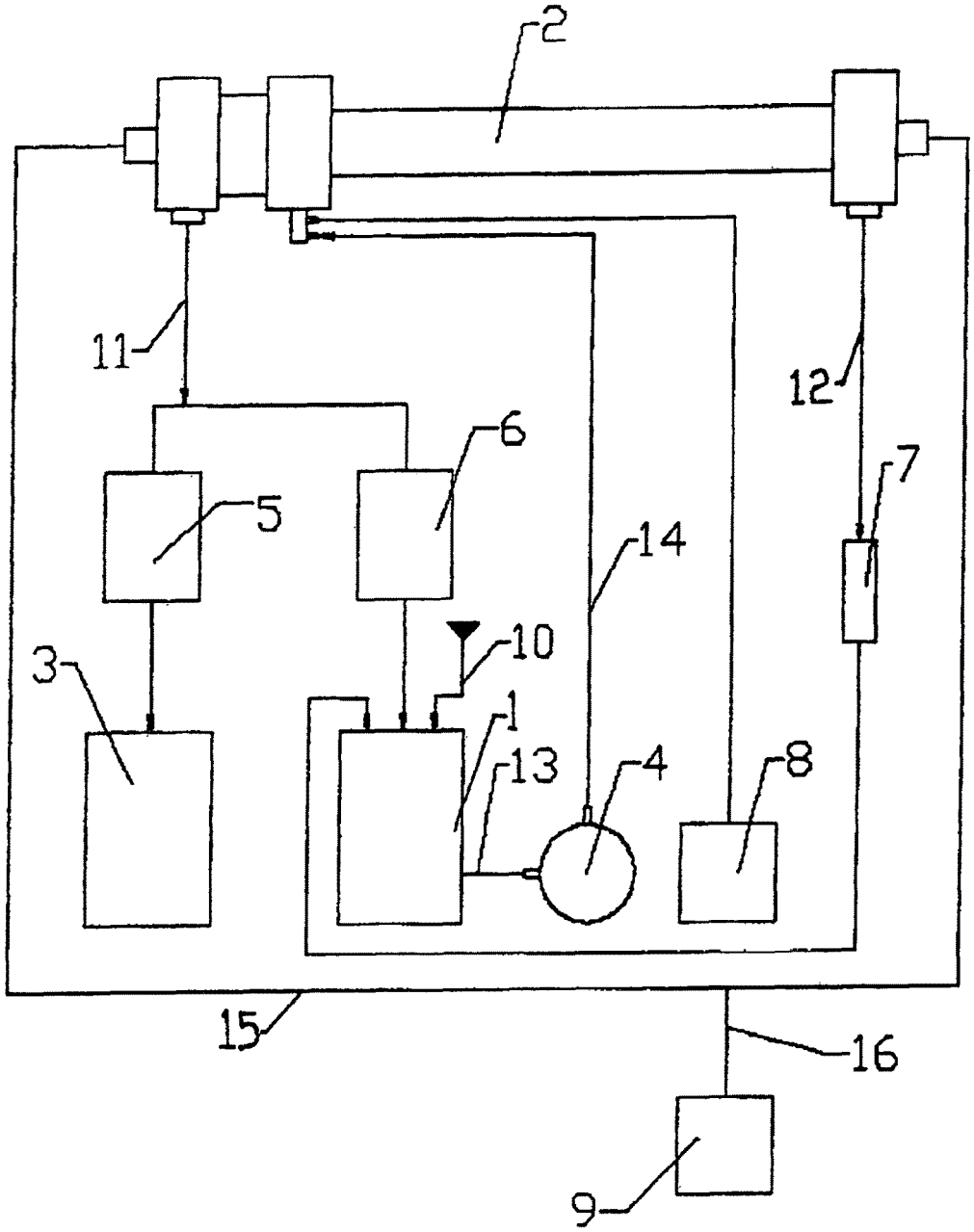
FIG. 1 is a schematic block diagram showing the overall construction and process of the present invention.

With reference to the drawings, the apparatus of the present invention includes an input storage device 1, swirling hydro-cavitational module 2, and the output storage 3 for treated oil, petroleum products or oil emulsion, pump 4, controlled shutters 5, 6 and 7, and switching electro-generator 8 for generating sonic/ultrasonic frequencies.

The storage device 1 is connected via the pipeline 10 to the input source of oil, petroleum products, or oil emulsion, and it is connected to pipelines 11 and 12 through shutter 6 and shutter 7 respectively to the output pipe junctions of the swirling hydro-cavitational module 2, and by pipeline 13 to the input port of the pump 4. The hydro-cavitational module 2 is connected to the infusing port of the pump 4 by pipeline 14; and it is also connected to the storage 3 by pipeline 11 via shutter 5. Electrical power supply for the hydro-cavitational module 2 is provided by way of switching electrical generator 8. The generator 9 of the sonic/ultrasonic frequencies is connected to the transducers by cables 15 and 16.

Figure 2:
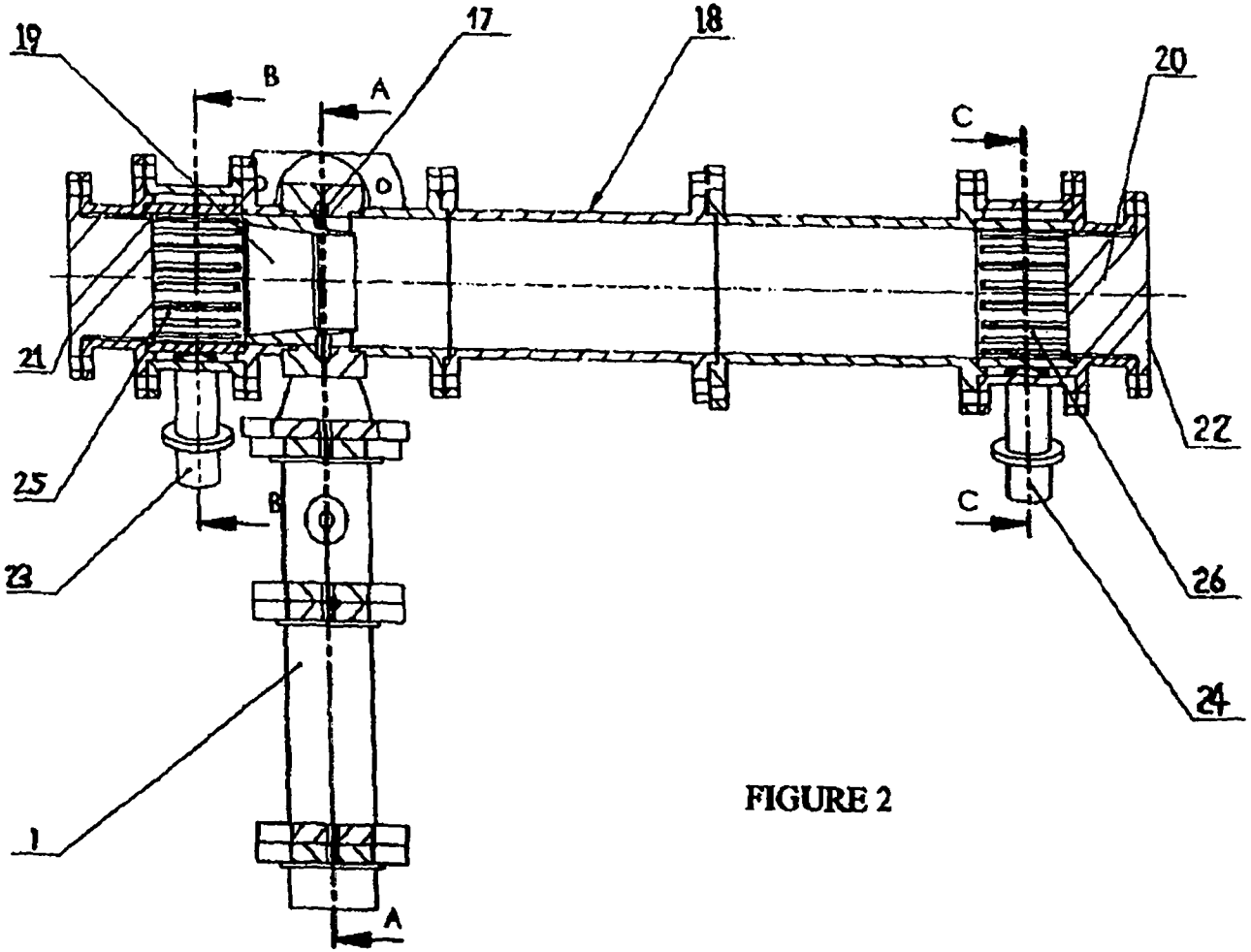
FIG. 2 is an oblong partial cross sectional perspective view of the swirling (vortex) hydro-cavitational module of the apparatus according to the present invention.
Figure 3:
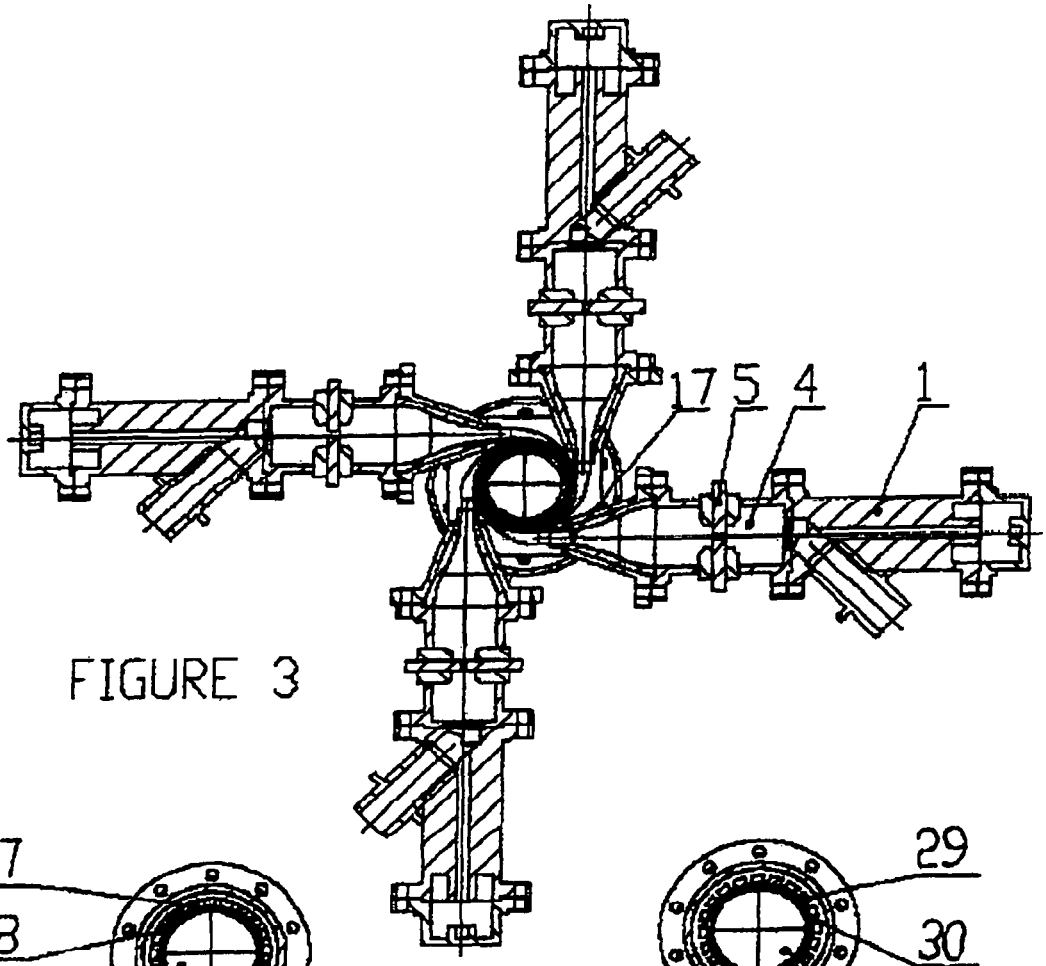
FIG. 3 is a cross sectional perspective view along section line A-A of FIG. 2.
Figure 4:
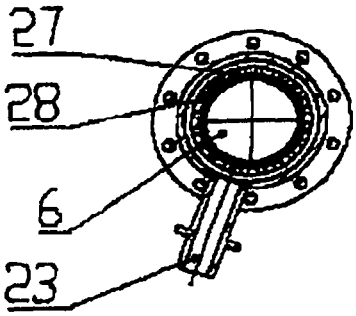
FIG. 4 is a cross sectional perspective view along section line B-B thereof.
Figure 5:
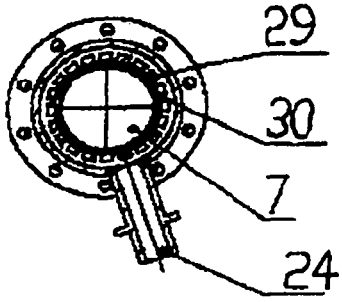
FIG. 5 is a cross sectional perspective view along section line C-C thereof.

As best shown in FIGS. 2 and 3, the swirling hydro-cavitational module 2 contains one or a plurality of serially located input storage devices 1. Each hydro-cavitational module 2 is provided with a tangential input nozzle 17 and a vortex chamber 18. The input storage device 1 is connected to a discharge outlet of the pump 4 while the intake pipe of the pump is connected to the fillable input storage device 1 by a pipeline. As shown in FIG. 1, each input storage device 1 is equipped with a discharge chamber, serving as a shutter 5, which, in turn, is connected to the switch electrical generator 8. As shown in FIG. 2, the vortex chamber 18 is provided with a plurality of acoustic transducers 19 and 20 located at its end walls 21 and 22. The plane of the transducers' operation surfaces is positioned perpendicular to the central axis of the vortex chamber 18. The acoustic transducers 19 and 20 are connected to the generator 9 by cable 16 and the swirling hydro-cavitational module 2 is equipped with two output devices 23 and 24 which are connected to the output pipelines 10 and 11 respectively as shown in FIG. 1. As shown in FIG. 2, the hydro-cavitational module 2 is provided with de-turbulizers 25 and 26 (see FIGS. 2, 3 and 5) that are located near its end walls 21 and 22 at the opposite ends of the vortex chamber 18. Since the acoustic transducers 19 and 20 are located inside the vortex chamber 18, the maximum diameter of the acoustic transducers 19 and 20 must be smaller than the minimum diameter of the de-turbulizers 25 and 26 which radially define the internal diameter of the vertex chamber 18. As shown in FIG. 1, the pipeline 23 is connected to the input storage device 1; and the output pipeline 11 is connected to both the input storage 1 and the output storage 3. As shown in FIGS. 4 and 5, the de-turbulizers 25 and 26 represent flat, radial blades 27 and 28 forming channels 29 and 30.

In operation, a petroleum product such as crude oil, or highly viscous stable oil emulsion from the input storage 1 is fed directly from the input storage 1 into the swirling hydro-cavitational module 2 in which a swirling, tensely twisted streamflow is formed into peripheral and central flows. A static pressure is then formed within the central flow of the vortex chamber 18; these pressures are equal to or less than those in a saturated vapor of a low boiling liquid so as to foster generations of intensive cavitations.

A vorticore flow in the field with a high gradient of the static pressure is subsequently heated up as a result of the combined effects of highly developed anisotropic turbulence, intense acoustic oscillations of low and high frequencies, cavitational exposures, and impact deceleration of both peripheral and central flows in the zones of de-turbulizers 25 and 26 (see FIGS. 4 and 5).

The central and peripheral flows are then directed to a re-circulation path. The latter allows the variations of the timing of treating the oil in the vortex chamber 18, to divide the output of the central and peripheral flows so as to permit separation of these flows according to their various different contents and properties, i.e. viscosities, densities and so on.

A stream directed to a formation of a swirling, tensely twisted flow is exposed to electro-hydrodynamic impacts in the discharging chamber 5 in the input storage device 1; those impacts are controlled by regulated frequency and power of the discharge by means of the switching electro-generator 8. Electro-hydrodynamic impacts are applied perpendicularly to the velocity vector of a moving flow. Varying frequency and power of the discharges allow controlling a working regime in relation to specifics of its applications and properties of thus processed oil or petroleum products.

A resulting vorticose flow is then exposed to acoustic oscillations of sonic or ultrasonic frequencies, while a counter-propagation of longitudinal oscillations are being created. The latter, featuring variable frequencies, would induce the formation of resonant modes that in turn would intensify the degree of their impact onto the flow of the processed oil.

Striking a forming flow with electro-hydrodynamic impacts and creating a twisted flow with a high radial gradients of pressure would result in the generation of a developed anisotropic turbulence; and exposing such flow to acoustic oscillations of sonic and ultrasonic frequencies would summarily lead to heating the flow, so as to invoke cavitations, which results in the formation of powerful impulses of pressure and intensified heat-mass exchange processes. Under the impacts of all the above factors, a breakdown of paraffin would occur to tear up the chemical bonds (C—C) with the formation of free radicals and carbamides in long structured molecules, and the breakdown of the mixture into light and heavy fractions would take place; and as a result the physical and chemical properties of the oil would alter so that its density and viscosity would be decreased.

Therefore, utilization of the process and apparatus of the present invention for treating oil, petroleum products and highly viscous stable oil formation, including viscosity reduction, clean-up and separation of emulsions, allows for the increase in efficiency and the reduction of energy consumption in the treatment processes.

What we claim is:

1. An apparatus for treating a petroleum product including oil, highly viscous stable oil emulsions for reduction of viscosity, cleansing and separation of emulsions, comprising:

an input storage tank for containing said petroleum products;

a swirling hydro-cavitational module serving as a reactor chamber and being connected to said input storage via a pump for delivering the flow of said petroleum product into and through said swirling hydro-cavitational module;

at least one input device having a discharge nozzle therein and connected to said swirling hydro-cavitational module with said discharge nozzle positioned tangential to said swirling hydro-cavitational module; said input device having a discharge chamber and a vertex chamber;

a plurality of acoustic transducers located at two end walls of said vortex chamber, and the working surface of said transducers being perpendicular to the longitudinal central axis of said vortex chamber; said transducers being operative with sonic/ultrasonic frequency generators;

two output devices with turbulizers positioned adjacent opposite end walls of said vortex chamber;

one of said input devices located at a nearest end of said vertex chamber being connected by pipelines to said input storage tank and an output storage tank for receiving said petroleum product input and the treated product respectively; and an output device located at a farther end from said swirling hydro-cavitational module end of said vortex chamber being a pipeline connected to said storage tank of the input of said petroleum product.

2. The apparatus according to claim 1 wherein said sonic/ultrasonic frequency generator is a switching electro-generator built with a regulated frequency and power of discharges, and electrodes forming said discharges are placed perpendicular to the central axis of the discharging chamber.

3. The apparatus according to claim 1 wherein said acoustic transducer are located at the end walls of said vortex chamber, and a plane of a working surface of said acoustic transducers is perpendicular to the central axis of the vortex chamber.

4. The apparatus according to claim 1 wherein said hydro-cavitational device is equipped with two de-turbulizers located near the end walls in the opposite ends of the vortex chamber, and said acoustic transducers having maximum diameter smaller than the minimum diameter of said de-turbulizers, and said de-turbulizers radially defining the internal diameter of said vertex chamber.

5. The apparatus according to claim 1 wherein the output devices of the vortex chamber are pipelined into an output storage tank by controlled shutters.

* * * * *